United States Patent [19]

Petrie et al.

[11] 4,385,605

[45] May 31, 1983

[54] ELECTRONIC IGNITION INPUT LOGIC

[75] Inventors: Adelore F. Petrie, Arlington Heights; Rupin J. Javeri, Elk Grove, both of Ill.

[73] Assignee: Motorola Inc., Schaumburg, Ill.

[21] Appl. No.: 310,028

[22] Filed: Oct. 13, 1981

[51] Int. Cl.[3] ..... F02D 5/16

[52] U.S. Cl. ..... 123/414; 123/643

[58] Field of Search ..... 123/414, 416, 417, 643, 123/617; 73/116

[56] References Cited

U.S. PATENT DOCUMENTS 4,250,846 2/1981 Menard ..... 123/416 X 4,313,414 2/1982 Planteline ..... 123/414 X 4,338,903 7/1982 Bolinger ..... 123/414 X 4,352,345 10/1982 Menard et al. ..... 123/416 X

*Primary Examiner*—Tony M. Argenbright

*Attorney, Agent, or Firm*—Margaret M. Parker; James S. Pristelski; James W. Gillman

[57] ABSTRACT

Information is derived from two given sets of sensor output pulses relating to crankshaft position for use in determining the proper cylinder to be fired, the spark time and the dwell. The spark is enabled only after the crankshaft position is known, and noise, including the spark itself, is prevented from interfering with the system operation.

8 Claims, 5 Drawing Figures

ELECTRONIC IGNITION INPUT LOGIC

CROSS REFERENCE TO RELATED APPLICATIONS

The present invention is related to the inventions described in claimed in copending U.S. patent application Ser. No. 310,004 and Ser. No. 310,029, filed as of even date with the present application. Both of these copending U.S. applications are assigned to the assignee of the present invention.

BACKGROUND OF THE INVENTION

This invention relates to the field of electronic ignition systems and, more particularly, to the provision of an essentially noise-immune crankshaft position detector circuit to be used for ignition control.

In the development of distributorless electronic ignition systems, many combinations of crankshaft portions with sensors for sensing the passing of each portion have been utilized. The combination of two sensors and three tabs or projections as shown herein forms a part of the prior art in this field, and the two sets of three pulses per crankshaft revolution are used in a system of which the present invention preferrably forms a part. There are however, problems in obtaining a desired control signal having only two pulses per crankshaft revolution from these two sets of pulses.

Also, since extraneous noise, and even the spark itself, can conceivably produce simultaneous pulses in the two sensor circuits, in addition to the pulses related to the flywheel projections, it is desirable to be able to prevent coincidental pulses from producing unwanted detects in the ignition system. It is also desirable to prevent any cylinder from being fired until the exact crankshaft position is known.

SUMMARY OF THE INVENTION

It is, therefore, an object of the present invention to utilize given sets of sensor output pulses to derive a desired set of control pulses.

It is also an object to use the control pulses within an electronic ignition system wherein the sensor output pulses relate to crankshaft position.

It is an additional object to inhibit dwell and spark until the crankshaft position is initially determined.

These and other objects which will become apparent are accomplished in the system in accordance with the invention wherein two sensor circuits provide separate sets of input pulses in response to crankshaft rotation. Each set contains three pulses per revolution, but only two of the pulses are coincidental. A first circuit including a latch is coupled to the sensor circuits and is controlled by the non-coincidental pulses of the two sets of pulses. A logic circuit is also coupled to the sensor circuits and provides an output signal in response to the coincidental pulses. An initialization circuit provides spark inhibiting signals in response to initialization of the system, then is disenabled by the output signal of the logic circuit. Another latching circuit is latched by the spark inhibit signal and released by the logic circuit output signal, and provides an output signal which enables the first latching circuit. The output signal of the first latching circuit is utilized for controlling the spark timing of the ignition system.

DETAILED DESCRIPTION OF A PREFERRED EMBODIMENT

Figure 1:
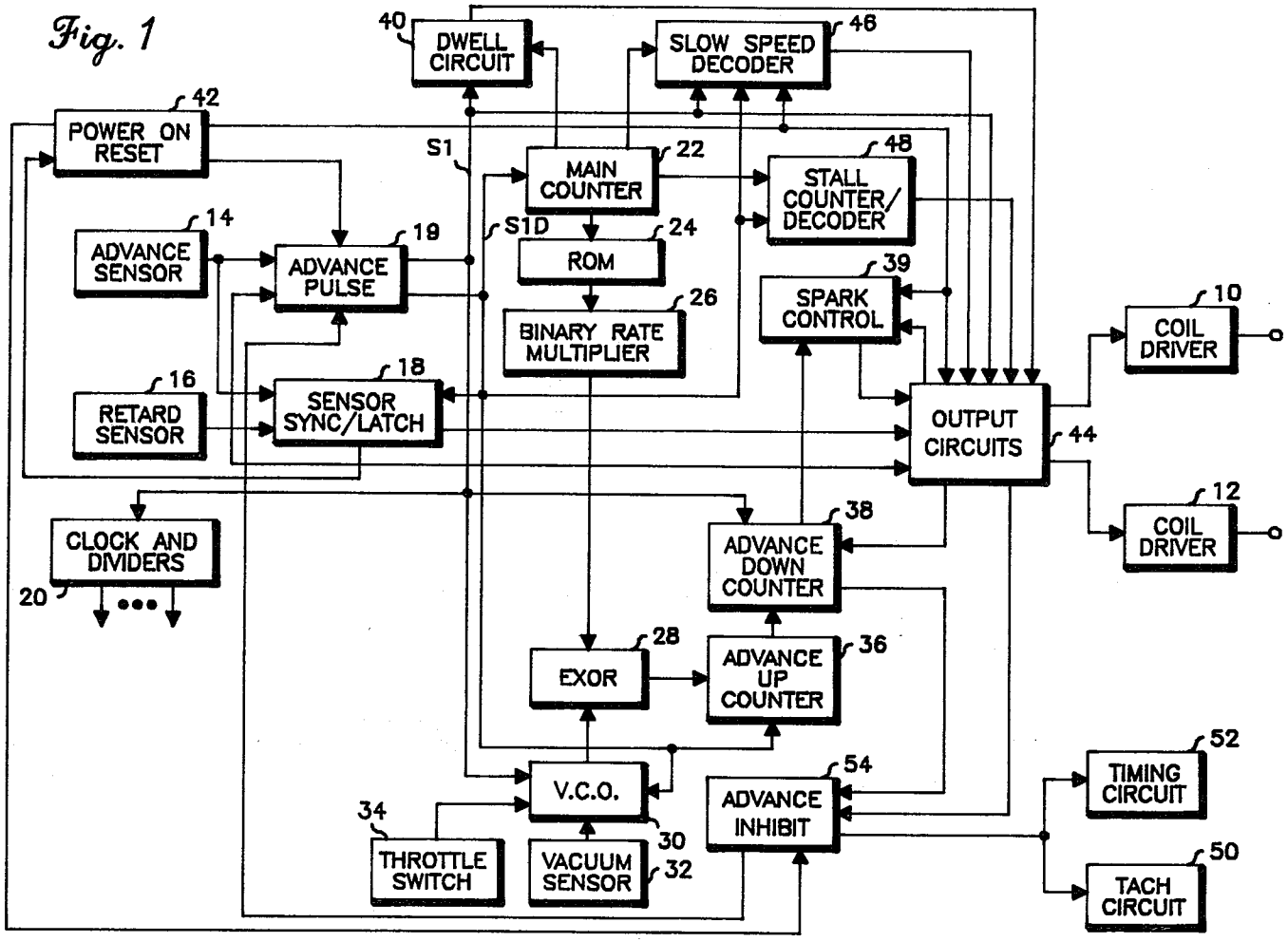
FIG. 1 is a block diagram of the overall system including the invention.

The block diagram of FIG. 1 illustrates a four cylinder automobile ignition system which includes one embodiment of the present invention. The system is an electronic advance (distributorless) system which is well suited to integrated circuit implementation. The invention is, however, not to be construed as limited to this particular system or to IC implementation but, rather, may be more easily understood in this environment.

As may be seen, two coil driver circuits 10, 12 are shown, each for energizing one coil, each coil supplying a spark to two cylinders (not shown), one during its power stroke and one during its exhaust stroke.

Figure 2A:
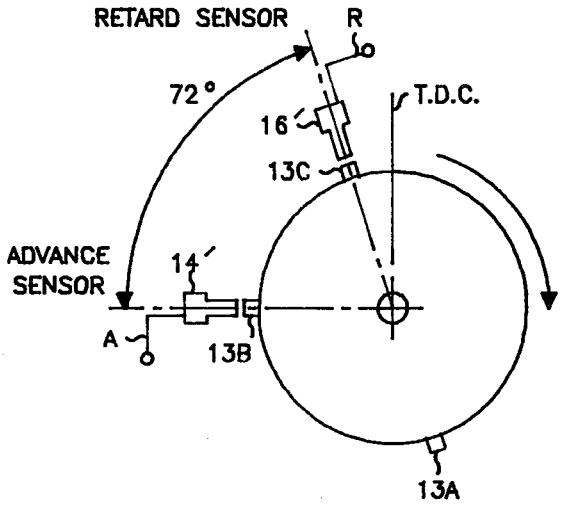
FIG. 2*a* is a diagram illustrating the positioning of the engine speed sensors and the tabs on the crankshaft.
Figure 2B:
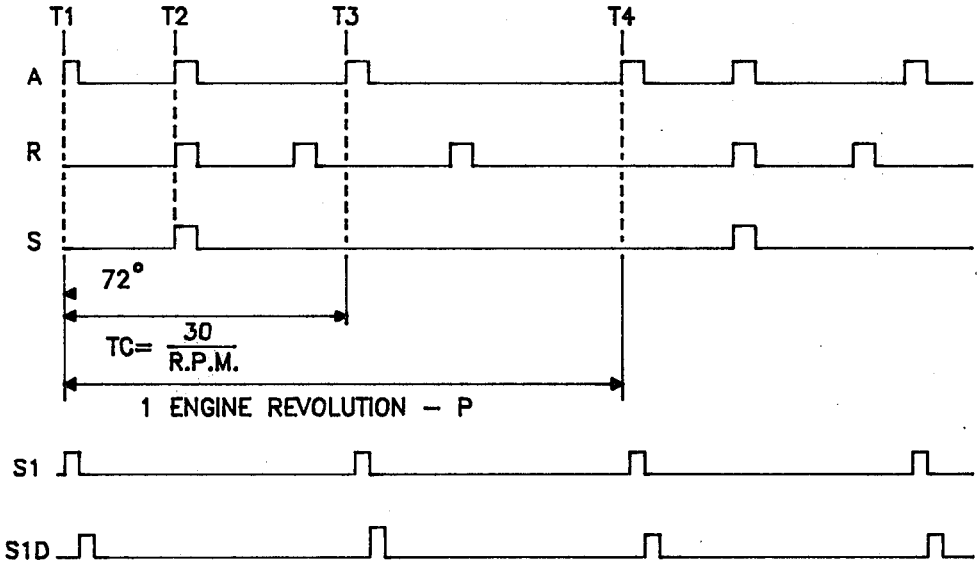
FIG. 2*b* is a timing diagram relating to the diagrams of FIGS. 2*a*, 3 and 4.

In FIG. 2A there are three projections 13*a*, 13*b*, 13*c* on a flywheel 13 of an engine (engine not shown). The projections are sensed by two proximity (Eddy current) sensors 14', 16' which are part of an "advance" sensor circuit 14 and a "retard" sensor circuit 16 respectively, as seen in FIG. 1. From FIG. 2A it can be seen that only once per crankshaft revolution (at T2 of FIG. 2B) will there be simultaneous pulses from the two sensors. This allows for a relatively exact determination of engine (crankshaft) position. FIG. 2B is a timing chart showing the pulses derived from the advance (A) and retard (B) sensors. From these three output pulses per cycle from each of these sensors, a synchronizing pulse (S) is obtained by a sensor synchronizing pulse circuit 18. The synchronizing pulse is used to determine which coil driver is to be enabled. An advance pulse circuit 19 provides an advance pulse (S1) in response to the leading edge of one of the advance sensor pulses and also provides a one-clock-pulse delay for the advance signal. The S1 pulse begins at the next clock pulse after the leading edge of the A pulse, and is one clock pulse wide. The delayed signal (S1D) is also used extensively for timing in the circuit. A clock and associated dividers 20 provide a number of clock signals which are used in the various counter circuits described hereinafter. A main counter 22 counts clock pulses between each two S1 pulses, thus the maximum count depends on engine speed. The counter 22 outputs are coupled to a ROM 24 and each count constitutes an address, thus the number of addresses explored between S1 pulses depends on engine speed. The data stored at each address in the ROM is a function of engine speed, the ROM having been programmed to provide the desired advance curve with respect to speed. The ROM output data is coupled to a binary rate multiplier (BRM) 26 which is also coupled to the clock/dividers 20. The BRM is coupled to one input of an EXOR 28. A voltage controlled oscillator (VCO) 30 is controlled by inputs from a vacuum (manifold pressure) sensor 32 and (optionally) a throttle switch 34. The VCO output is coupled to a second input of the EXOR 28, which then performs an adder function on the two sets of input pulses. That is, unless two pulses have exactly coincidental leading or trailing edges, each EXOR input pulse will be represented by one output pulse. The output of the EXOR 28 is coupled to an advance upcounter 36 which increments from one S1D pulse to the next. The count in the advance upcounter 36 is transferred to an advance downcounter 38 once during each cycle but, since the downcounter 38 is clocked at a higher rate than the upcounter 36, the count down requires less time then the count up. At the end of the advance count down, a spark control circuit 39 may initiate the spark for the appropriate cylinders.

Since the dwell time must be controlled for all engine speeds, it is necessary to, in effect, "count back" from the required spark time (by counting down from the previous spark), in order to determine the correct dwell time beginning. This is done by a dwell counter 40 which also receives the maximum count from the main counter. The count in the dwell counter is rapidly decremented a fixed number of counts, then held until spark time occurs, then decremented at the same rate as the main counter. Dwell begins at the zero count of the dwell counter.

A power-on-reset circuit (POR) 42 prevents any cylinder from being fired initially until the sensor synchronizing pulse circuit 18 has determined the crankshaft position, thus preventing the wrong cylinder from being fired. Gating circuits in output circuits 44 process the spark control signals being coupled to the coil drivers 10, 12. A slow speed decoder 46 detects any overflow of the main counter 22 (which indicates a low speed condition) and forces the spark to occur with no advance angle. A counter in a stall decoder 48 also receives the main counter overflow and when the stall decoder counter overflows (indicating the engine speed is going into a "stall" condition), primary coil current is slowly decreased to zero and the whole system is shut down. A signal from an advance inhibit circuit 54 inhibits any advance pulses during the spark period and can also be coupled to a tachometer circuit 50 or any other timing circuit 52 requiring a direct correlation with engine speed, such as a control for fuel injection.

Figure 3:
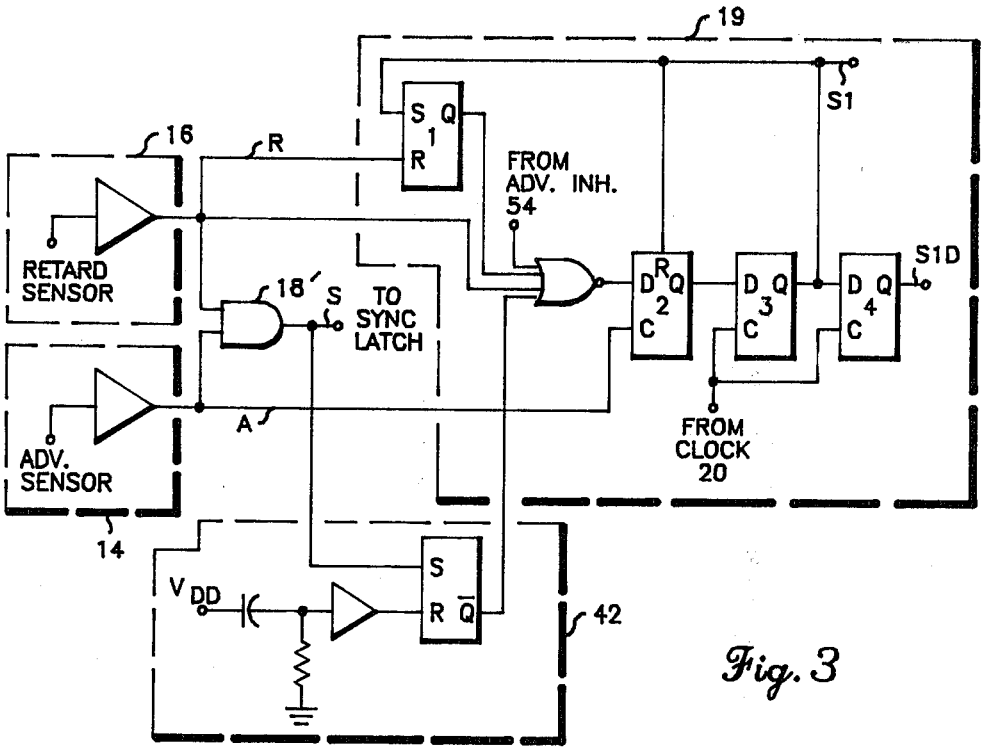
FIG. 3 is a logic diagram of one embodiment of the invention.

FIG. 3 is a logic diagram of the relevant portions of the system of FIG. 1, and will be described with respect of the timing diagram of FIG. 2B, as will FIG. 4.

In FIG. 3, the advance sensor circuit 14 provides the three pulses (A) per crankshaft revolution (P) as shown in FIG. 2B, while the retard sensor circuit 16 provides three pulses R which lag signal A by 72° in this embodiment. These two signals A, R are combined in the AND gate 18' which is a part of sensor sync/latch circuit 18. The AND gate output is shown as sync signal S and consists, naturally, of a pulse for each coincident pair of A and R pulses. The signal S is used, among other things, to set a latching circuit in the power-on-reset circuit (POR) 42. The latch in the POR circuit 42 is reset each time the circuit is initialized as by the turning on of the ignitin switch (not shown). The output of the latch is coupled to a NOR gate in the advance pulse circuit 19 and serves to inhibit ignition until the first sync pulse S is obtained. Thus it is not possible for the wrong cylinder or cylinders to be fired due to an initial lack of crankshaft position information. An additional input to the NOR gate in advance pulse circuit 19 is designated an "advance inhibit" signal. This signal comes from the advance inhibit circuit 54 and, under certain engine conditions, including spark time, inhibits generation of the S1 pulse.

The signals A and R are also used in the circuit to provide signals S1 and S1D which are used extensively in the system for controlling the dwell and spark timing. It will be seen that if the signal R were coupled directly to the flip-flop #2 in the advance pulse circuit 19, S1 and S1D pulses would be produced before the crankshaft position is determined, thus there would be a strong possibility of firing the wrong cylinder on the initial spark. By inhibiting the production of an S1 pulse in the interval between initialization (as turning on the ignition key) and the establishment of the crankshaft position (detection of the coincident sensor pulses) the first ignition coil to be energized is the proper one. It is to be noted here that signal S1 of the timing chart of FIG. 2B assumes that the system is past the initialization and that an S pulse has been obtained previously.

Subsequently, a sequence of an R pulse and an A pulse will enable an S1 pulse, but coincidental R and A pulses will not since the R pulse will block the flip-flop #2 from setting. Therefore, only the non-coincidental pairs of A and R pulses will produce S1 pulses; if there is more than one A pulse before an R pulse, the first A pulse will produce an S1 pulse, setting the flip-flop #1 and inhibiting the passage of any additional pulses through the flip-flop #2 until the next R pulse resets the flip-flop #1. Thus there will be only two S1 pulses per crankshaft revolution (period P of FIG. 2B).

Figure 4:
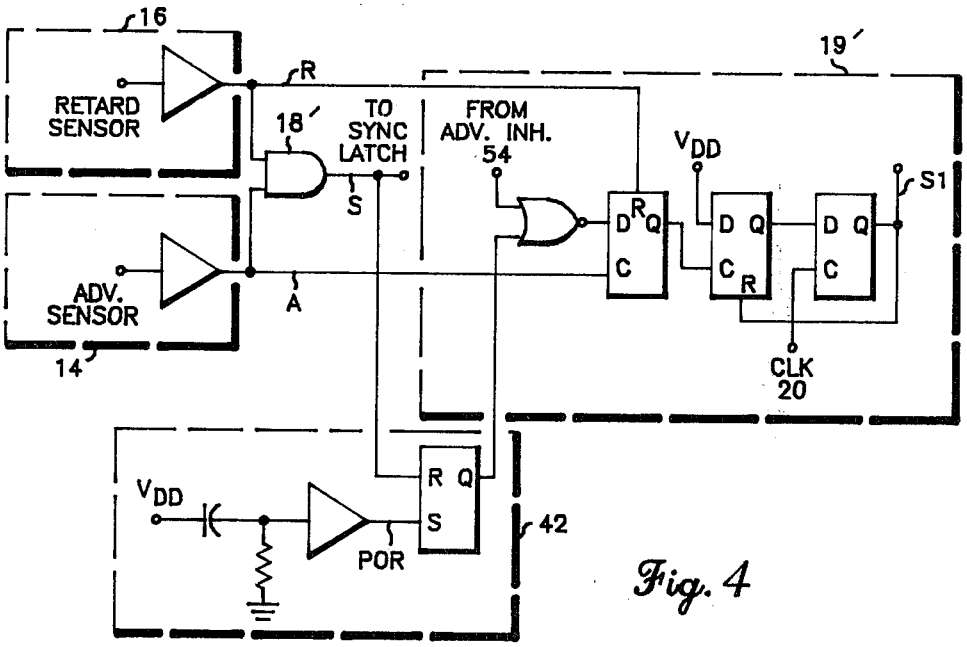
FIG. 4 is another embodiment of the invention similar to FIG. 3.

FIG. 4 is a slightly different embodiment of the circuit of FIG. 3 which produces the same general results. Blocks marked with a primed numeral represent circuits similar to but not identical to the correspondingly numbered blocks of FIG. 3. Again, the sensor circuits 14 and 16 provide signals A and R in response to crankshaft rotation and these signals are coupled to the AND gate 18' in sensor sync/latch circuit 18. The output signal S of the AND gate is the set signal for the POR latch 42. The POR latch is reset by ignition switch turn on or other initialization signal. The output signal of the POR latch 42 is coupled to the NOR gate in advance pulse circuit 19' along with the output from the advance inhibit circuit 54 to inhibit output from flip-flop #2' before the first sync pulse S or during spark.

After the first advance sensor pulse A has set flip-flop #2', additional pulses of signal A will not change the state of the Q output until a retard sensor pulse R has reset the flip-flop #2'. The R pulse on the reset will also override any A pulses on the clock of flip-flop #2' during coincidental A and R pulses, driving the output low and holding it low. Thus, only the noncoincidental pairs of A and R pulses will produce S1 pulses, and there will be only two S1 pulses per crankshaft revolution period (P of FIG. 2).

Flip-flops #5 and #3' produce an S1 pulse for each input pulse from flip-flop #2 and can be coupled to flip-flop #4 (FIG. 3) to produce an S1D delayed pulse.

Thus there has been shown and described a system for providing, from two given sets of sensor pulses, a desired set of control signals for controlling the spark in an electronic (distributorless) ignition system. The system used only those sensor pulses as required to provide the appropriate control signals. The dwell control signal is inhibited until a determination is made of the crankshaft position. The inhibit signal is derived from an initialization signal and is released by a sync signal obtained from the given sensor signals by logic circuits within the ignition system. As may be seen, the system can be used to provide other engine control functions such as fuel injection control. It is obvious that other variations and modifications of the present invention are possible and is intended to cover all such fall within the spirit and scope of the appended claims.

What is claimed is:

1. A control circuit for an electronic ignition system and comprising:

a first input means for providing a first set of input pulses in response to engine crankshaft rotation;

a second input means for providing a second set of input pulses in response to crankshaft rotation, each set of input pulses including three pulses per crankshaft revolution and only one pair of pulses being coincidental;

first latching means coupled to the first and second input means for providing an ignition control signal in response to the non-coincidental pulses;

first logic means coupled to the first and second input means for providing a reference signal in response to the coincidental pulses;

second logic means for providing a control signal in response to initialization of the control circuit, said control signal preventing enablement of the first latching means, and wherein the second logic means is coupled to the first logic means for being disenabled by said reference signal; and second latching means coupled to the first and second logic means for being latched by the control signal and released by the reference signal, the output of the second latching means being coupled to enable the first latching means.

2. A control circuit according to claim 1 wherein each of the first and second input means includes a sensor for sensing the presence of predetermined portions of the crankshaft and the spacing of the first and second input means is related to the spacing of the predetermined portions on the crankshaft.

3. A control circuit according to claim 1 wherein the ignition control signal provides at least one timing function in said ignition system.

4. A control circuit according to claim 1 wherein the first latching means provides a second ignition control signal in response to the first ignition control signal for providing at least one timing function in said ignition system.

5. A system for deriving ignition timing information and reference cylinder information and comprising;

a member rotatable at engine speed and having three detectable portions, two of said portions being spaced apart by a predetermined angle;

first and second sensors positioned adjacent the rotatable member for providing first and second sets of pulses respectively, each pulse in response to the proximity of one of said detectable portions to a sensor;

coincidence detector means coupled to the sensors for providing a first output pulse in response to each pair of substantially simultaneous pulses, the first output pulses providing cylinder reference signals;

intialization means for providing a second output signal in response to initialization of the system; and logic means enabled by the second output signal for providing a timing signal in response to a predetermined pair of non-simultaneous pulses coming from the first and second sensors.

6. A system according to claim 5 wherein the logic means includes delay means for providing a second timing signal derived from the first timing signal.

7. A control circuit for an electronic engine control system wherein the engine includes a rotatable member coupled to the crankshaft and bearing detectable portions, and two sensors positioned adjacent the member for providing two sets of input signals in response to said portions, the circuit comprising:

first circuit means for providing a cylinder reference signal in response to coincident pairs of input signal pulses;

second circuit means for inhibiting the utilization of a first set of input signals until a cylinder reference signal pulse is obtained;

third circuit means for providing an ignition control signal in response to the input signals; and fourth circuit means for preventing the utilization of the coincidental pairs of input signal pulses by the third circuit means.

8. A control circuit according to claim 7 and further including fifth circuit means for inhibiting the provision of the ignition control signal during the ignition spark.

* * * * *